United States Patent [19]

Orchard, 3rd

[11] Patent Number: 4,977,691

[45] Date of Patent: Dec. 18, 1990

[54] SHOE INSOLE WITH BOTTOM SURFACE COMPRESSION RELIEF

[75] Inventor: Lewis P. Orchard, 3rd, Seal Beach, Calif.

[73] Assignee: Spenco Medical Corporation, Waco, Tex.

[21] Appl. No.: 304,755

[22] Filed: Jan. 31, 1989

Related U.S. Application Data

[63] Continuation-in-part of Ser. No. 236,077, Aug. 23, 1988, abandoned.

[51] Int. Cl.[5] ..... A43B 13/38; A43B 13/40; A43B 23/08

[52] U.S. Cl. ..... 36/44; 36/91; 128/622; 128/621

[58] Field of Search ..... 36/28, 30 R, 31, 43, 36/44; 128/621, 622

[56] References Cited

U.S. PATENT DOCUMENTS

| | | | |
|---|---|---|---|
| 2,658,288 | 11/1953 | Scholl | 36/44 |
| 2,748,502 | 6/1956 | Scholl | 36/44 |
| 4,346,205 | 8/1982 | Hiles | 528/53 |
| 4,541,184 | 9/1985 | Leighton | 36/44 |
| 4,541,186 | 9/1985 | Mulvihill | 36/114 |
| 4,581,187 | 4/1986 | Sullivan et al. | 264/46.4 |
| 4,616,430 | 10/1986 | McQuiggin | 36/14 |
| 4,627,178 | 12/1986 | Sullivan et al. | 36/44 |
| 4,627,179 | 12/1986 | McElroy | 36/44 |
| 4,674,204 | 1/1987 | Sullivan et al. | 36/44 |
| 4,694,589 | 9/1987 | Sullivan et al. | 36/44 |

FOREIGN PATENT DOCUMENTS

| | | |
|---|---|---|
| 2445115 | 12/1978 | France . |
| 6234501 | 8/1985 | Japan . |

OTHER PUBLICATIONS

Spenco Medical Corporation, "Dealer Product Catalog", 302–0369, p. 6 (date unknown).

*Primary Examiner*—Daniel P. Stodola
*Assistant Examiner*—Joseph A. Rhoa
*Attorney, Agent, or Firm*—William B. Boykin

[57] ABSTRACT

An insole (10) for athletic shoes and the like. A first layer (12) of the insole is suitable for disposition toward a user's foot. A second molded layer (14) is comprised of a visco-elastic material. The visco-elastic material typically comprises a plasticizer, and, in minor portion, a resin material, and has the ability to flow, upon exertion of a force thereon, with sufficient elasticity to resume its original shape upon removal of the force. The second layer comprises a lower surface comprising recesses which make up less than 20% of the exterior surface in the absence of deforming forces. The recessed areas function to receive adjacent material of the second layer upon application of pressure representative of the presssure applied by the human foot. A third optional layer (16) of a foamed plastic material may be interposed between the first and second layers.

19 Claims, 2 Drawing Sheets

FIG. 5

SHOE INSOLE WITH BOTTOM SURFACE COMPRESSION RELIEF

This is a continuation-in-part of Ser. No. 236,077, filed Aug. 23, 1988, now abandoned.

CROSS REFERENCE TO RELATED APPLICATIONS

A cushioned article having a layer of visco-elastic material and method of making same is disclose in related U.S. patent application Ser. No. 07/236,062, filed on even date herewith, entitled "SHOE INSOLE AND METHOD OF FABRICATING IT", commonly assigned to the assignee of the present invention.

BACKGROUND OF THE INVENTION

Separately formed insoles may be loosely inserted into athletic and other shoes. The present invention relates to insoles which are characterized in providing comfort, helpful distribution of weight on the foot, impact dampening and absorption of shock, and distribution of pressure applied by the foot, through a combination of vertical and lateral deformations of the bottom surface of the insole.

Some insoles are thermoformed to the general shape of the foot and shoe. Others are simply flat sheets cut to shape. Sometimes a permanently deformable material (i.e. one with a high compression set) is used to permanently conform the insole to the user's foot during initial use. Sometimes a cushioning material (i.e. one with a low compression set) is used to provide resilience and shock absorption without conforming to the user's foot.

SUMMARY OF INVENTION

This invention provides an insole for athletic shoes and the like comprising a first layer of a liner suitable for disposition toward a user's foot and a second layer of a visco-elastic material The visco-elastic material has the consistency of natural soft human tissue, and has the ability to flow, upon exertion of force thereon, with sufficient elasticity to resume its original shape upon removal of such force. The composition of the visco-elastic material comprises a plasticizer and, in minor portion, a resin material, which is compatible with the plasticizer.

The second layer comprises a heel area corresponding to the heel area of a user's foot, a ball area corresponding to the ball area of a user's foot, an arch area corresponding to the user's arch, and a toe area corresponding to that area overlain by the ends of the user's toes. Relief areas may be positioned between (1) the ball area and the toe area and (2) the ball area and the arch area.

The second layer has a lower exterior surface which comprises a composite recessed area. The recessed area comprises less than about 20%, preferably less than about 12%, more preferably less than about 8% of the area of the lower exterior surface, in the absence of deforming forces. The recesses function to receive adjacent material of the second layer which flows toward the recesses upon application of pressure representative of pressure applied by the human foot. Thus, as the recesses receive the adjacent material, the volume defined by the recesses, adjacent the applied pressure, is reduced, usually by at least about 20% in response to pressure representative of that applied by the human foot, preferably at least about 40%, more preferably at least about 60%.

In preferred embodiments, the lower exterior surface is devoid of recesses in the ball area and the toe area, but has recesses in the adjacent relief areas on either side of the ball area. In the heel area, the lower exterior surface preferably has a uniform, repeating pattern of recesses. In some preferred embodiments, the recesses in the heel area are functionally continuous channels, and interconnect to form islands on the lower exterior surface It is preferred that the heel area be at least 1.25 times as thick as the ball area, more preferably at least 1.5 times as thick. The thicker heel is especially preferred in combination with a pattern of recesses which comprise interconnecting channels that form islands In preferred embodiments, the specific gravity of the second layer is at least about 0.75, such that resilience and flowability of the material of the second layer results primarily from (i) elastomeric flow properties of the composition and (ii) from the ability of the material adjacent the lower surface to deform and be received into the recesses; and is not primarily dependent upon flow of the material into internal interstices within the second layer itself, as is the case with some, and especially lower density, foamed materials.

DETAILED DESCRIPTION OF THE ILLUSTRATED EMBODIMENTS

Figure 1:
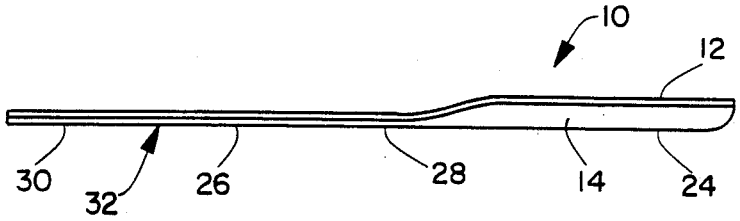
FIG. 1 shows a side view of a two layer insole of the invention.
Figure 2:
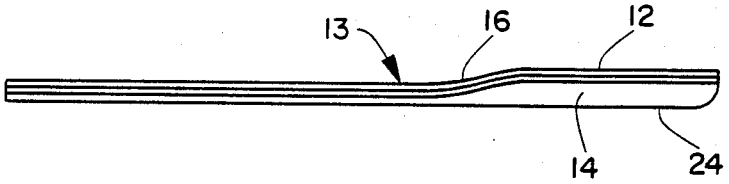
FIG. 2 shows a side view of a three layer insole of the invention.

FIG. 1 shows an insole 10 comprised of a first layer 12 of a fabric liner for disposition toward the user's foot, and a second layer 14 of visco-elastic material attached to the first layer 12. FIG. 2 shows a three layer insole of the invention. The first layer 12 is the fabric liner as in FIG. 1. The second layer 14 is the visco-elastic material as in FIG. 1. Interposed between the first and second layers is an intermediate layer 16 of a foamed plastic material having a compression set of between 10% and 40%.

As discussed herein, the term "compression set" refers to the property of the recovering of a deformable material after removal of the deforming force. The compression set is that fraction of the compression amount which is not recovered by the material after a period of 6 hours after release of the compression force.

The term "visco-elastic" as used herein refers to materials which, when deformed by a deforming force, return to their original-or nearly original-shape upon release of the deforming force. In some cases, they return to their original shape immediately. In other cases, they return to their original shape over a period of time, such as 6–8 hours.

A preferred visco-elastic material for the second layer 14 can be described as a polymeric solution comprising, in major portion, a plasticizer and in minor portion, a resin. Those skilled in the art will recognize that many such plasticizer/resin combinations are possible and that each plasticizer is chosen with regard to its characteristics when combined with each resin. Suitable resins are those providing low viscosity, high molecular weight, relatively uniform particle size, and, of course, compatibility with a plasticizer, both as a finished product and as regards the ability to admix homogeneously therewith during processing. A further property of the preferred composition of the second layer is that the resulting mixture has the consistency of natural soft human tissue at room temperature, such that it can distribute shock forces in much the same manner as shock is distributed by human tissue. The resulting mixture, when made into insoles as disclosed herein, can also be generally characterized by its Shore Hardness which, on the Shore 00 scale, is between 20 and 60, preferably between 30 and 50, more preferably between 40 and 45.

Polyvinyl chloride (PVC) resins, when combined with appropriate plasticizers, provide these characteristics and are preferred Particularly preferred are PVC resins having specific gravities of approximately 1.4. The most preferred PVC resins are those which have a specific gravity of about 1.4, and which are high in molecular weight and have a relative viscosity (1% in cyclo-hexanone at 25° C.) of about 2.85. Such resins are classified D5-22 (ASTM-D-1755). PVC resins suitable for providing these characteristics have excellent compatibility with dialkyl phthalate, impart improved strength, and resist exudation of plasticizer from the resulting visco-elastic material compositions.

The plasticizers, as noted above, are chosen with regard to the particular resin employed It has been noted that, with respect to the resin/plasticizer combinations useful in producing the visco-elastic materials of the present invention, one gauge of compatibility is the greasiness of the feel of the final mixture of the two materials, namely the rate at which plasticizer is released from the mixture. In general, the more greasy the final materials are to the touch, the faster the plasticizer is being released and the less compatible are the resin and plasticizer as a combination The preferred dialkyl phthalate plasticizers have low volatility, high stability, low melt viscosity, and good processability and compatibility with PVC resins. In particular, dialkyl phthalate wherein the alkyl groups are mixed $C_7$, $C_9$, and $C_{11}$ and are predominantly linear are preferred. Particularly preferred is n-heptyl n-nonyl n-undecyl phthalate with a molecular weight of about 414 and a boiling point of about 252° C. Visco-elastic materials can be prepared from the resin and plasticizer components alone. When PVC and dialkyl phthalate are employed, the preferred component ratios are approximately 3 parts plasticizer to 1 part resin, by weight.

In addition to the plasticizer and resin components, the preferred visco-elastic materials of the present invention also include stabilizers. As used herein, the term "stabilizer" refers to any additive to plasticized resin mixtures which tends to impart resistance to degradation either during processing of the material or in the formed material itself Such stabilizers will, of course, be chosen with regard to the particular plasticizer/resin system, and should be chosen with toxicity and skin irritation properties in mind in accordance with the contemplated end use of the product. When the above described combination of dialkyl phthalate plasticizer and PVC resin is employed, the preferred stabilizers are a combination of an epoxy based stabilizer and a metallic salt based stabilizer. In particular, epoxidized soy oil (or linseed or other vegetable oil) and BaZn phenate or CaZn phenate stabilizers are preferred. In a dialkyl phthalate/PVC system, these two preferred stabilizers, while not strictly necessary in the end product, have been found to provide advantages during processing, apparently by preventing thermal degradation.

The first layer 12 of the insole shown in FIG. 1 is formed of a fabric such as nylon, polyester, felt, or the like. Alternately, layer 12 may be fabricated of leather, or a leather-like material which is capable of breathing, to dissipate body moisture and the like.

The visco-elastic material of layer 14 preferably has a compression set of less than 10%, preferably less than 5%, and in many cases approaching 2% to 3% or less. An elastomeric material having such a low compression set provides a relatively time-stable insole platform for providing shock absorption properties to the user over an extended period of time.

With respect to the three layer embodiment shown in FIG. 2, intermediate layer 16 provides the combination of a softer cushioning layer, and a compression set, in a thin layer, which provides a degree of conformance to the individual user's foot. This combines the advantages of the resilience of the low compression set of the visco-elastic material of layer 14 on the lower portion of insole 10 with the lateral support and vertical support over an increased area of the foot surface attendant the moderate compression set characteristics of layer 16 as exhibited at the upper surface of the insole. The combination of the moderate compression set of layer 16 and the resilient visco-elastic properties of layer 14 provides an advantageous combination of benefits, including a high degree of comfort consistent with good impact resistance, and healthful distribution of the weight on the feet in substantially all situations of normal use.

The composition of intermediate layer 16 can be any of the foamed polymers which exhibit a compression set of about 10% to about 40%. Exemplary of these foamed polymers is an ethylene polymer having a density of 30 to 100 kilograms per cubic meter. With respect to that ethylene polymer foam, a preferred thickness for layer 16 is between 1 mm. and 5 mm. thick.

Preferably, the heel area 24 of the insole is thicker than the toe area 30. In that regard, the extra thickness is desirably in layer 14; wherein the thickness of layer 14 in the heel area 24 is at least about 1.25 times, preferably at least about 1.5 times as thick as the thickness of layer 14 in the area 26 of the ball of the foot. This provides extra cushioning to the heel area of the foot.

Further exemplary of visco-elastic material which can be used in layer 14 of the insoles of this invention is that described in U.S. application Ser. No. 676,090 "COMPOSITIONS AND METHOD FOR PRODUCING PAD STRUCTURES WITH VISCO-ELASTIC CORES" filed Nov. 29, 1984, now U.S. Pat. No. 4,756,949 herein incorporated by reference. Generally, however, the material used in the present invention contains a lower ratio of plasticizer to resin than in the cited patent.

The composition of the visco-elastic material of layer 14 can include both active and/or passive additives, in addition to those disclosed hereinabove, within its composition without departing from the spirit of the invention. While no additional additives are required for operability of the invention, certain embodiments may desirably use them.

Illustrative of the contemplated additives are fillers such as talc, cork, natural or synthetic fibers, and the like, all non-chemically reactive components which typically modify physical properties moderately, and may reduce the cost of the insoles made therewith. Such additives are typically used in small amounts, such as up to about 20% by weight, so as to retain the major portion of the benefits of the physical properties of the visco-elastic material, although up to 40%, and even 50% may be used in some embodiments. Certain of the additives may exhibit cooperation in the use of the insole, such as by absorbing body moisture and drawing it away from the foot, or by promoting minor fissures in the visco-elastic surface or body to encourage moisture dispersion or air flow between the insole and the foot.

Finally, minor amounts of chemically functional additives may be used to enhance the visco-elastic setting process, to enhance mold release, anti-blocking, or slip characteristics, or the like. Such chemically functional additives are usually limited to less than about 10% by weight of the visco-elastic composition, preferably no more than 5%, and are typically in the range of 2–3%.

Figure 3:
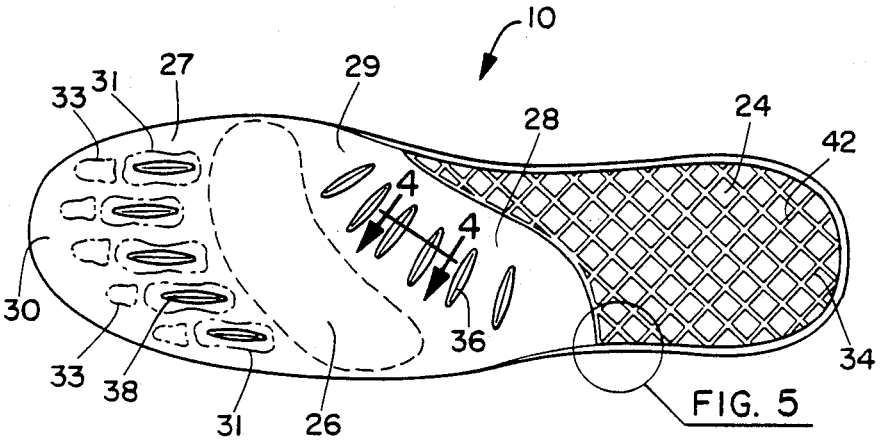
FIG. 3 shows a bottom view of the insole of FIG. 1, with some of the toe bones shown in phantom.

Referring now to FIG. 3, the insole 10 has a heel area 24, corresponding to the heel of a user's foot, a ball area 26 corresponding to the ball of a user's foot, an arch area 28 between heel area 24 and ball area 26 and corresponding to the arch of a user's foot, a toe area 30 corresponding to a user's toes, and two relief areas 27 and 29 on either side of ball area 26. Relief area 27 is between ball area 26 and toe area 30. Relief area 29 is between ball area 26 and arch area 28. Relief area 27 is generally defined by the second bone segments 31 of the user's toes, shown in phantom outline in FIG. 3, while the end bone segments 33, corresponding to the end portions of the user's toes, overlie the toe area 30. The general location of ball area 26 is behind the toes, and is outlined on FIG. 3 with a dashed line.

It is generally known that the ball of the foot carries much of the body weight in walking, and in most cases also in running. It is also known that the heel of the foot most directly and effectively transmits to the upper body structure, and especially the legs, the shock produced in the foot during running and walking. The toes, and especially the toe ends, provide balance and directional support. While insoles may serve a plurality of functions, salient among these functions is cushioning of the foot, and consequently the body structure, against the shocks associated with vigorous foot use. Thus it is desirable to design the insole to provide increased cushioning to those areas of the foot which are subject to the greatest and potentially most damaging shocks, namely the heel of the foot (to protect the upper body structure) and the ball (for foot comfort).

Referring now to FIG. 2, it is seen that the heel area 24 of visco-elastic layer 14 is thicker than the rest of layer 14. Since layer 14 has cushioning, flowable, visco-elastic properties, the increased thickness of layer 14 at heel portion 24 provides increased cushioning at the heel 24 as compared to the cushioning provided to the rest of the foot. Typically, heel portion 24 of layer 14 is at least about 1.25 times, preferably at least about 1.5 times as thick as the rest of layer 14. Heel portion 24 of layer 14 is usually not greater than about 2 times, and especially not greater than 3 times, the thickness of the rest of layer 14.

Figure 4:
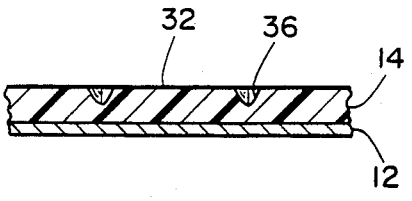
FIG. 4 shows a cross-section of a portion of the insole taken at 4—4 of FIG. 3.

The outer surface layer 14 at heel area 24, relief area 29, and relief area 27 has recesses 34, 36, and 38 respectively, as seen generally in FIG. 3. As seen in FIGS. 3 and 4, the recesses 36 in relief area 29 provide a pattern of generally side-by-side trough-shaped depressions which are closed on both ends. Recesses 38 in relief area 27 are similarly configured, with the individual recesses preferably corresponding in general relationship to the positioning of the individual toes, the toe bones being shown in phantom. Referring again to FIG. 3, it is seen that ball area 26 is preferably devoid of recesses as is toe area 30. Since the ball of the foot and the toes are primary components to control body direction, lateral stability of the ball and toes is important to foot directional control. Thus it is important to provide an optimum balance of good cushioning and good lateral stability at the ball area 26 and toe area 30.

Cutting relief areas into the surface 14 provides the combination of reduced cushioning and increased lateral mobility. The reduced cushioning may be recovered by increasing the overall thickness of layer 14, but this further laterally destabilizes layer 14 by the increased thickness. And while lateral destabilization is acceptable as regards vertical shock, it is detrimental to directional control. Thus, recesses are generally undesirable in ball area 26 and toe area 30. However it is desirable for material which flows laterally as a result of pressure placed on the ball area 26 and toe area 30 to have some place to go. Recesses 36 in relief area 29 border ball area 26 and provide that relief for lateral flow of visco-elastic material, as these recesses receive lateral flow of visco-elastic material from ball area 26 when pressure is applied by the ball of the user's foot. Similarly, recesses 38 in relief area 27, between ball area 26 and toe area 30, receive lateral flow of visco-elastic material from both ball area 26 and toe area 30.

Maximum vertical cushioning for the ball and toe areas is achieved by maximizing the amount of visco-elastic material in the ball area 26 and toe area 30. Maximum lateral stability is obtained by minimizing the thickness of the deformable visco-elastic material. So, in order to provide maximum vertical cushioning while concurrently providing as high a degree of lateral stability as possible, it is important to fully occupy the volumes of ball area 26 and toe area 30 with the visco-elastic material of layer 14, whereby ball area 26 and toe area 30 are devoid of recesses.

Correspondingly, it is appreciated that forces applied to ball area 26 and toe area 30, as by the weight of the human body, do cause deformation of the visco-elastic material of layer 14, as by vertical thinning of layer 14 by compression, and thereby cause corresponding lateral flow of the visco-elastic material away from the areas experiencing the compressive thinning. Thus it is highly desirable to provide relief areas adjacent the compressively thinned ball and toe areas, in order to allow the lateral material flow to be absorbed within the area of the insole article without deformation of the entire insole article. Thus are relief areas 27 and 29 provided, with recesses 36 and 38, adjacent the ball area 26 and toe area 30, to receive those lateral material flows.

Figure 5:
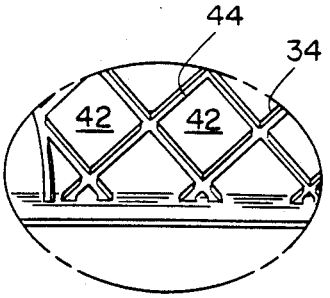
FIG. 5 shows an angled, enlarged pictorial view of the circled area labeled "FIG. 5" in FIG. 3.
Figure 6:
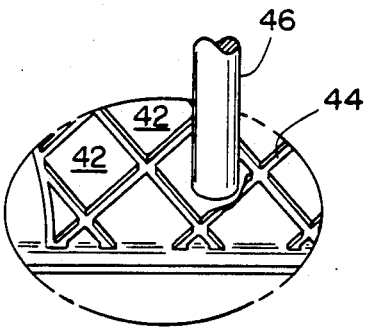
FIG. 6 shows an angled, enlarged view as in FIG. 5, and showing channel deformation when a load is applied.

Referring now to FIGS. 3 and 5, it is seen that recesses 34 in heel area 24 are illustrated as a uniform repeating pattern comprising continuous, interconnected channels 44 which form islands 42 on the lower exterior surface 32 of the insole. And since lateral control of the foot is not primarily affected by lateral control of the heel, a minor increase in heel mobility is acceptable. This increase in heel mobility results from the increased cushioning which accompanies the combination of the increased thickness of the heel portion and the concurrent additional cushioning provided by the lateral material flow relief provided by the channels 44. Contrary to ball area 26 and toe area 30 where lateral stability is critical to directional control, and wherein relief areas are thus undesirable, and increased thickness of layer 14 is undesirable thereat; in heel area 24, minor reduction in lateral control is acceptable and increased cushioning is highly desirable for protection of the upper body structure, and especially the leg. Thus are channels 44 (comprising heel recesses 34) uniformly spaced throughout heel area 24. Desirably channels 44 interconnect to form islands 42 which act as individual load centers according to the localized pressure applied on each one. To the extent a pressure as at 46 (FIG. 6) is applied on an island 42, the visco-elastic material flows vertically, but it also flows laterally into an adjacent channel 44, reducing the volume defined by the channel via its sidewalls and bottom and an imaginary extension of bottom surface 32 of the insole (FIG. 4). This lateral flow, and the accompanying reduction in volume of the adjacent channel 44, are seen in FIG. 6. In a desirable configuration, bottom surface 32 of the heel area is divided into a plurality of islands 42. Thus the lateral flow of visco-elastic material at surface 32 is generally confined to the boundaries of the islands receiving the pressure. And islands which do not receive the pressure are not laterally deformed, except in their neighbor-supporting role, as described hereinafter.

In the preferred embodiments, the sizing of the islands and the associated recesses (and also the other recesses on surface 32) is coordinated so that, upon application of pressure representative of a user's foot, the volume of the directly adjacent recesses is reduced by at least about 20%, preferably at least about 40%, more preferably about 60%. Within this range, the sidewall of a channel generally deforms enough to contact the opposite sidewall of an adjacent neighbor island, and to gain supplementary lateral support from that neighbor island. Where the volume of the channel is reduced less than 20%, the sidewall may not be touching the adjacent neighbor island, whereby the stabilizing and supporting influence of that adjacent island is not realized. Where the volume is reduced by more than 60%, localized areas of the surface 32 may not have adequate volume in the adjacent recesses to receive all the material which could flow laterally, with a resultant reduction in cushioning affect.

In coordination of the volume of the recesses with the area of surface 32, it is generally desirable that the recesses, as at 34, 36, and 38, comprise less than about 20%, preferably less than about 12%, more preferably less than about 8% of the area of surface 32.

Especially with respect to the heel area 24, applicants have found that, in preferred pattern of islands 42 and channels 44, the islands are between 3 mm. and 15 mm., preferably between 4 mm. and 10 mm., in length and width, and the channels are between 0.2 mm. and 2 mm., preferably 0.3 mm. and 1.0 mm. wide. It is especially preferred that the channels be less than about 1.5 mm. wide, and that the islands have length and width dimensions, corresponding to directions generally at right angles to each other, of no more than 10 mm. in at least one direction and no more than 15 mm. in the other direction. Where the islands are larger overall than the above recited dimensions, the independent action of the islands, relative to the insole as a whole is diminished, whereby the advantageous benefits of the island structure are not obtained. Depth of channels 44 is preferably less than 2 mm, more preferably less than 1 mm.

The cushioning and associated lateral relief provided by the insoles of the instant invention is generally achieved by the visco-elastic properties of the material in layer 14. Thus, the insoles of this invention do not rely, for their shock-absorbing properties, on internal intersticial deformation relief as is found in foamed materials. Thus, the specific gravity of layer 14 is generally greater than about 0.75, which allows for a minor amount of foam structure in layer 14, but not enough to greatly influence the flow/deformation properties of the layer. Rather, the material of layer 14 is usually not foamed, whereby its density is usually greater than 0.85 g/ml, and may be greater than 0.95 g/ml, depending on the composition used in layer 14.

The preferred method of the invention for producing insole structures from visco-elastic materials includes preparation of a resin concentrate, and combination of plasticizer and colorant with the resin concentrate to make the final composition of the visco-elastic material.

While forming a resin concentrate is not required, the most preferred process includes such a step. Basically, the resin concentrate is prepared by employing heat and admixing all of the resin to be used with a minor amount of the total plasticizer to be employed.

The above described resin concentrate is then added to the major portion of plasticizer to be employed in the batch. Preferably, plasticizer is placed in a mixing container and the resin concentrate is added thereto with mixing. The preferred ratio of plasticizer to resin concentrate is about 0.7:1 by weight.

The visco-elastic material can be delivered to a holding container which is fitted with stirring means and heat sources so as to provide continuous agitation and heat to the thus-formed fluid visco-elastic composition.

Figure 7:
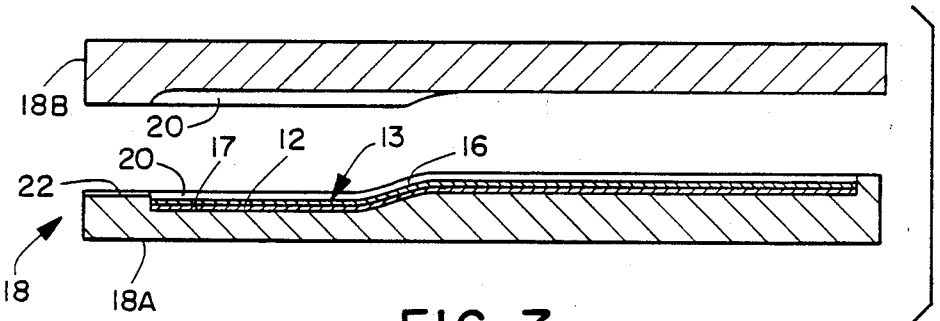
FIG. 7 shows a cross-section of a mold used to make the insoles of the invention, and also shows the second and third layers of the insole placed in the mold.

Referring to FIG. 1, in formation of the insoles of the invention, the insole upper portion 13, also known as a mold insert, and comprising the fabric liner 12 and the optional foamed layer 16 is placed in the mold 18. Insert 13 is positioned on the upper surface 17 of the lower member 18A of the mold 18. The upper mold member 18B of mold 18 is then joined with the lower mold member 18A in closing the mold. Insert 13 preferably extends along the length and width of the cavity 20 defined between upper and lower mold members 18B and 18A. The fluid visco-elastic material, prepared as described herein, is then introduced into the mold through port 22. As seen in FIG. 7, insert 13 is positioned between upper surface 17 of lower mold member 18A and the visco-elastic material introduced through port 22. Where insert 13 is between the visco-elastic material and surface 17, there is essentially no contact between the visco-elastic material and the surface 17. Rather, surface 17 is contacted directly by insert 13.

Delivery of the visco-elastic material to mold 18 in fabrication of the insoles 10 of the invention can be done in a variety of ways, but preferably is accomplished using a heated extruder means which increases the temperature of the material as it is delivered from the holding container through the extruder into the molds. An especially advantageous pattern of recessed areas, seen at 34, 36, and 38 in FIG. 3, is formed on the upper surface of the visco elastic material (as viewed in FIG. 7) by a pattern, not shown, which is provided in upper mold member 18B. The filled mold 18 is then cooled. Upon cooling, the visco-elastic material is capable of maintaining its shape, including the pattern of recessed areas, absent a deforming force. The mold is then opened, and the molded insole is removed from the mold. Conventional mold release agents may be used as desired. Post-molding operations are the same as those conventionally practiced in molding elastomeric materials. In the insoles of the invention, the visco-elastic material is usually bonded directly to the insert 13.

A particularly preferred visco-elastic material can be produced from a minor portion of PVC resin and a major portion of a dialkyl phthalate plasticizer. For example, a resin concentrate can be prepared as follows: First, about 41 parts by weight of dialkyl phthalate plasticizer is pumped into a mixing container. To the dialkyl phthalate is added about 5 parts by weight of an epoxidized soybean oil stabilizer and about 6 parts by weight of a metallic salt stabilizer. The preferred epoxidized soybean oil has a commercial name of "Interstab Plastoflex 2307," and can be purchased from John Watson of Dallas, Tex. The preferred metallic salt stabilizer is BaZn phenate, which has the trade name of "Synpron 940" and can be purchased from Synthetic Products of Cleveland, Oh. To this mixture is added approximately 100 parts by weight of PVC resin. The resin concentrate is prepared by heat and mixing, with addition of plasticizer until the ratio of plasticizer to resin is about 150:100.

About 2 parts by weight of dialkyl phthalate plasticizer, is pumped into a large container. To this is added about three parts by weight of resin concentrate. At 25° C. the plasticizer has a density of about 0.97 g/ml and the resin concentrate has a density of about 1.15 g/ml. Coloring agents can be added as desired. The dialkyl phthalate plasticizer, resin concentrate, and coloring are thoroughly mixed. This mixture is pumped into a holding container which is continuously stirred and heated to maintain the mixture at a temperature of from about 38° C. to about 46° C. From the holding container, the mixture can be extruded into a mold, such as mold 18. The extruder has a heater, which is set at about 260° C. During the extrusion process, the visco-elastic material enters the extruder at a temperature of from about 38° C. to about 46° C. and exits the extruder into the mold at a temperature of from about 166° C. to about 177° C.

The molded visco-elastic material is then cooled to set the visco-elastic material in formation of the layer 14 of insole 10.

The following example is provided, not to limit the processes used in the invention, but rather to further aid one skilled in the art in understanding the process by which visco-elastic materials can be used in fabrication of shoe insoles of the present invention.

EXAMPLE

Approximately 275 lbs. of dialkyl phthalate plasticizer are delivered to a 270 gallon mixing tank. To the plasticizer is added 33 lbs. of epoxidized soybean oil (Interstab Plastoflex 2307) and about 40 lbs. of BaZn phenate (Synpron 940). To this mixture is added 650 lbs. of polyvinyl chloride resin. A resin concentrate is prepared from the above components by heating and mixing the above components, and by adding plasticizer until a total of about 975 lbs. of plasticizer is present in the resin concentrate.

Next approximately 181 lbs. of dialkyl phthalate is introduced into a second container. The dialkyl phthalate has a density of about 0.97 g/ml at 25° C. To the plasticizer is added 284 lbs. of the resin concentrate formed as described above. A colorant is added to the second container, and the resin concentrate, plasticizer, and colorant are thoroughly mixed. The mixture is then transferred to a third holding container which is continually stirred, and is heated to a constant temperature of approximately 46° C.

A mold similar to that shown at 18 in FIG. 7 is prepared to receive the resin-plasticizer mixture by placing inserts 13 into the molds and closing the molds. The mixture is then pumped through an extruder into the mold, in fabrication of shoe insoles. The extruder has an oil heater which is set at 260° C. and heats the incoming liquid to an exit temperature of approximately 177° C.

The resin-plasticizer material is delivered to the mold and is cooled in the mold causing the liquid mixture to set, whereby it becomes a visco-elastic material at room temperature. The setting of the visco-elastic material, in fabrication of layer 14, generally completes the fabrication of the insoles. The mold is then opened and the completed insoles are removed.

The invention herein has been described in detail with respect to an insole wherein the upper surface, as at layer 12 generally comprises a straight line across the width of heel area. As is well known in the art, the top surface of the heel area can be cupped, whereby the sides and back of the heel generally conform to the three dimensional shape of the heel. Such third dimensional conformance is generally provided in large part by the primary structural layer, which in this invention is layer 14. Thus layer 14 may have a non-linear top surface in the heel area, generally conforming to the surface of a heel, to accommodate further improved cushioning and lateral stabilization of the heel of the user's foot.

Thus does the invention provide novel shoe insoles made with visco-elastic materials, and composite structures made with those visco-elastic materials. Those skilled in the art will now see that certain modifications can be made to both the compositions of the layers disclosed for use in the insole as well as to the insole structure, without departing from the spirit of the instant invention. While the invention has been described above with respect to its preferred embodiments, it will be understood that the invention is capable of numerous rearrangements, modifications and alterations and all such arrangements, modifications and alterations are intended to be within the scope of the appended claims.

What is claimed is:

1. A shoe insole comprising a first upper layer, said first upper layer comprising a liner suitable for disposition toward a user's foot, and a second lower layer of visco-elastic material, said second layer having the ability to flow, upon exertion of force thereon, said second layer comprising a heel portion corresponding to the heel area of a user's foot, a ball area corresponding to the ball area of a user's foot, an arch area corresponding to the arch area of a user's foot, and a toe area corresponding to the end portions of a user's toes, said second layer having a lower exterior surface, said lower exterior surface having recesses in at least one relief area adjacent said ball area, said ball area being functionally devoid of said recesses.

2. A shoe insole as in claim 1 wherein said relief area is between said ball area and said arch area.

3. A shoe insole as in claim 2 and including a second relief area between said ball area and said toe area.

4. A shoe insole as in claim 3 wherein said toe area is functionally devoid of said recesses.

5. A shoe insole as in claim 4, the composition of said visco-elastic material comprising a plasticizer and, in minor portion, a resin material compatible with said plasticizer.

6. A shoe insole as in claim 2 wherein said toe area is functionally devoid of said recesses.

7. A shoe insole as in claim 1 wherein said relief area is between said ball area and said toe area.

8. A shoe insole as in claim 7 wherein said toe area is functionally devoid of said recesses.

9. A shoe as in claim 1 wherein said toe area is functionally devoid of said recesses.

10. A shoe insole as in claim 9, the composition of said visco-elastic material comprising a plasticizer and, in minor portion, a resin material compatible with said plasticizer.

11. A shoe insole as in claim 1, the composition of said visco-elastic material comprising a plasticizer and, in minor portion, a resin material compatible with said plasticizer.

12. A shoe insole with bottom surface compression relief which comprises:

a substantially planar visco-elastic layer which has a consistency of natural soft human tissue, an ability to flow upon exertion of force thereon, and which has a bottom surface which defines a toe area corresponding to the end portions of a user's toes, a ball area corresponding to the ball area of a user's foot, an arch area corresponding to the arch area of a user's foot, a first relief area between the toe area and the ball area, and a second relief area between the ball area and the arch area.

wherein at least one of the first relief area or the second relief area has a recess for receiving flow of viscoelastic material from the ball area when pressure is applied by the ball of a user's foot, and the ball area is functionally devoid of recesses;

so that the insole may absorb shock and distribute pressure applied by a user's foot through a combination of vertical and lateral deformations of the bottom surface of the insole.

13. The insole of claim 12, wherein the surface has a recess in the first relief area only.

14. The insole of claim 12, wherein the surface has a recess in the second relief area only.

15. The insole of claim 12, wherein the surface comprises generally side-by-side trough-shaped recesses in the first relief area, and generally side-by-side trough-shaped recesses in the second relief area.

16. The insole of claim 12, wherein the surface comprises generally side-by-side trough-shaped recesses in the first relief area, and generally side-by-side trough-shaped recesses in the second relief area, and the ball area and toe area are functionally devoid recesses.

17. The insole of claim 12, wherein the surface has interconnected channels in the heel area for receiving lateral flow of viscoelastic material.

18. The insole of claim 12, wherein the viscoelastic layer comprises a plasticizer and, in minor proportion, a resin material compatible with the plasticizer.

19. A shoe insole with bottom surface compression relief which comprises:

a liner suitable for disposition toward the sole of a user's foot; and a visco-elastic layer operationally connected to the liner, which comprises a plasticizer and, in minor proportion, a resin material compatible with the plasticizer, and which has a bottom surface which defines a toe area corresponding to the end portions of a user's toes, a ball area corresponding to the ball area of a user's foot, an arch area corresponding to the arch area of a user's foot, a heel portion corresponding to the heel area of a user's foot, a first relief area between the toe area and the ball area, and a second relief area between the ball area and the arch area;

wherein the bottom surface has a pattern of generally side-by-side trough-shaped recesses in the first relief area, and a pattern of generally side-by-side trough-shaped recesses in the second relief area, for receiving flow of viscoelastic material from the ball area when pressure is applied by the ball of a user's foot, but no recesses in the ball area or in the toe area, and the lower exterior surface also has a pattern of interconnected channels in the heel area for receiving the flow of viscoelastic material;

so that the insole may absorb shock and distribute pressure applied by a user's foot through a combination of vertical and lateral deformation of the lower exterior surface.

* * * * *